United States Patent [19]

Balz

[11] 4,329,817

[45] May 18, 1982

[54] FINISHING APPARATUS

[75] Inventor: Gunther W. Balz, Kalamazoo, Mich.

[73] Assignee: Roto-Finish Company, Inc., Kalamazoo, Mich.

[21] Appl. No.: 871,175

[22] Filed: Jan. 23, 1978

Related U.S. Application Data

[63] Continuation-in-part of Ser. No. 670,643, Mar. 26, 1976, abandoned, which is a continuation of Ser. No. 554,399, Mar. 3, 1975, abandoned, which is a continuation of Ser. No. 355,343, Apr. 30, 1973, abandoned.

[51] Int. Cl.[3] ..... B24B 31/00

[52] U.S. Cl. ..... 51/163.2

[58] Field of Search ..... 51/163.1, 163.2, 7; 241/175

[56] References Cited

U.S. PATENT DOCUMENTS

| | | | |
|---|---|---|---|
| 3,197,922 | 8/1965 | Smith | 51/163.1 |
| 3,266,739 | 8/1966 | McKibben | 51/163.2 |
| 3,268,177 | 8/1966 | McKibben | 51/163.2 |
| 3,570,192 | 3/1971 | Ferrara | 51/163.2 |
| 3,633,321 | 1/1972 | Rise | 51/163.2 |
| 3,680,266 | 1/1972 | Shiplou | 51/163.1 |
| 3,693,298 | 9/1972 | Ferrara | 51/163.1 |
| 3,708,918 | 1/1973 | Pool | 51/163.2 |

FOREIGN PATENT DOCUMENTS

| | | | |
|---|---|---|---|
| 2043204 | 12/1971 | France | 51/163.1 |

*Primary Examiner*—Harold D. Whitehead
*Attorney, Agent, or Firm*—Gordon W. Hueschen

[57] ABSTRACT

A gyratory machine for finishing parts, grinding such as paint grinding, or screening, having a fixed frame and a floating support resiliently mounted thereon, a finishing chamber mounted on the floating support, a gyratory motion-producing assembly affixed to the support comprising a vertically mounted housing, a plurality of bearings mounted in the housing, one or more vertically oriented shafts rotatably journaled in the bearings, and eccentric weights mounted on the shaft or shafts in fixed radial relationship thereto, a motor mounted on said housing for gyratory motion therewith and coupled to the shaft by a belt and pulley coupling assembly. The belt and pulley assembly applies rotating force to the shaft at a driving point or plane external with respect to the bearings, that is, at a point axially external to that portion of the shaft included between or defined by the bearings. In a further improved embodiment the annular finishing chamber is readily demountable from the floating support. In still another embodiment, a hinged ramp gate is provided alternatively to permit the parts which are being finished to return to the starting point of the finishing chamber, or to be discharged from the finishing chamber.

5 Claims, 7 Drawing Figures

FINISHING APPARATUS

This application is a continuation-in-part of my prior-filed, copending application Ser. No. 670,643, filed Mar. 26, 1976, and now abandoned, which in turn is a continuation of my prior-filed, copending application Ser. No. 554,399, filed Mar. 3, 1975, now abandoned, which is in turn a continuation of my application Ser. No. 355,343, filed Apr. 30, 1973, now abandoned.

BACKGROUND OF THE INVENTION (1) Field of Invention

The present invention relates to a gyratory finishing machine having a curvilinear finishing chamber, and more particularly refers to such an apparatus having a vertically oriented gyratory motion-producing assembly and power driving means so mounted that the coupling-speed ratio may be readily changed, and the power driving means may be readily removed for repair or replacement.

(2) Prior Art

Gyratory finishing machines having vertically oriented motors and eccentric weight assemblies are known in the art. Such machines are used for various forms of finishing, such as abrading, burr removal, burnishing, polishing, and grinding. Such machines are disclosed and claimed in U.S. Pat. No. Re. 27,084, 3,400,495, 3,423,884, 3,435,564, 3,466,815, 3,606,702, and 3,633,321. In such apparatus, the motor is permanently affixed to the inside of a tubular frame, and the eccentric weights are mounted on the motor shaft. Machines of the type described are vibrated in such a manner that a gyratory motion is produced, that is, a motion wherein the axis of the vibrating portion of the machine is inclined from the vertical and describes substantially a pair of conical surfaces as it gyrates. As a result of the gyratory motion, when material such as parts and/or finishing material are placed in a chamber having a bottom of arcuate cross-section which is caused to vibrate by the gyratory motion, orbital motion is imparted to the material so that it moves upwardly at the peripheral portion of the chamber and downwardly at the inner portion of the chamber. This results in relative movement between the finishing material and parts, causing the parts to be finished. Additionally, by the use of a proper phase relationship between the eccentric or unbalance weights, varying degrees of precession or linear progression of the material and parts are caused circumferentially around the annular finishing chamber.

In most prior art machines the gyratory motion-producing parts of the apparatus are mounted in a housing generally in the form of a vertical tube. The motor is bolted to the inside wall of the tubular housing, generally at a central portion thereof, and the eccentric or unbalance weights are directly mounted on the two opposite external ends of the motor shaft. Because of the exceptionally strong gyratory forces set up by rotation of the eccentric weights, the motor must be specially designed and must have extremely heavy duty bearings. Such specially built motors are very expensive. Moreover, because of the extreme stresses to which the motor is subjected, the motors must be repaired or replaced at rather frequent intervals. In order to remove an internally mounted motor of the type described, the entire apparatus must be disassembled. This is a costly and time-consuming process. Additionally, when it is necessary to reline the tub or finishing chamber, the motor must be removed and the entire assembly sent to another place for relining.

Prior art machines have also been constructed utilizing a separate shaft having the eccentric weights mounted thereon, a motor mounted on the housing, having belt and pulley drive, and with a pulley mounted on the shaft intermediate the bearings. In such an apparatus it is difficult to change the pulleys and belt in order to achieve various driving ratios, since the apparatus must be disassembled to get at both the pulleys and the belt. Moreover, it is difficult to remove the motor from within the tube.

Gyratory finishing apparatus of the type described has been disclosed in which the motor is mounted externally of the apparatus on a fixed and non-vibrating portion of the frame. In one such structure disclosed in U.S. Pat. No. 3,693,298, the motor is mounted on a fixed portion of the frame of the finishing machine coupled to the floating or gyratory portion by means of pulleys and a belt, one pulley being mounted on the motor and the other on the vertical gyratory shaft supporting the eccentric weights. In such structure a vibratory force is applied to the belt by the gyrating pulley.

Another such structure wherein the motor is rigidly mounted on a fixed portion of the frame of the finishing machine is shown in Pool U.S. Pat. No. 3,708,918. It is obvious that, in such a structure wherein the vibratory force is applied to the belt by the gyrating pulley, or vice versa, much is left to be desired from the standpoint of engineering and economic efficiency, as will immediately be apparent to anyone skilled in the art.

Vibratory finishing apparatus has also been developed which utilizes a drive motor mounted on a fixed base and coupled to the eccentric weight shaft by means of a flexible coupling and universal joint. This arrangement is suitable only for apparatus utilizing a horizontal tub and a horizontally mounted eccentric weight shaft at the bottom thereof. Such apparatus does not undergo gyrational motion but only translational movement at low amplitude. Moreover, in such apparatus some power is dissipated in the universal joint. Additionally, the universal joint must be frequently replaced.

Another apparatus suitable only for use in connection with a horizontal tub and a horizontally mounted eccentric weight shaft is shown in Shiplov U.S. Pat. No. 3,680,266, which apparatus again does not undergo gyrational motion but only translational motion at low amplitudes. The pulley in Shiplov is moreover clearly inside his bearings inasmuch as his shaft is mounted in plate 22.

In the case of a vertically mounted rotating eccentric weight system, the amplitude of the gyrational movement of the ends of the shaft is so great that it would be virtually impossible to power the shaft by means of a stationary motor operating through a universal joint and certainly a pulley coupled to the end of the shaft.

This has been recognized in the prior art by experts in the field, for example, in Ferrara U.S. Pat. Nos. 3,570,192 and 3,693,298 in which the Applicant Ferrara, commenting upon gyratory finishing machines of the type here concerned, respectively states as follows:

> "Conventionally, the vibratory mechanism is enclosed within a protective housing. Often, the unbalanced weights are mounted directly to the shaft of an electric motor, and the housing of the electric motor is mounted directly to the bowl. In such instances, it is commonly found that inadequate ventilation and moisture accumulation contribute to the rapid failure of the electric motor. In other instances, an electric motor or other prime mover is used to drive a separate shaft having the unbalanced weights. In such instances, it is difficult to provide a satisfactory coupling between the prime mover and the shaft because the shaft vibrates eccentrically when rotated. In any such instance, the load on the bearing means intermediate the shaft carrying the unbalanced weights and the housing is constantly unbalanced. Consequently, bearing wear is excessive and average bearing life is short."

and

"Conventional vibratory finishing machines produce a vibratory movement of the vertical center shaft which is too violent to permit use of a drive belt arrangement thereby necessitating that the drive motor be mounted directly on the bowl assembly."

Accordingly, Ferrara, in his two patents, provided extremely complicated equipment to remedy the problems and shortcomings which were apparent to him as stated in the foregoing. The present invention, quite to the contrary of the experience of the prior art, as representatively expressed by Ferrara in his two foregoing identified patents, is based upon the discovery that the problems observed by Ferrara, as one skilled in the art, which made it difficult if not impossible to provide a satisfactory coupling between the prime mover and the central vertical shaft, because the shaft vibrates eccentrically when rotated in a gyratory machine of the present type and because the gyratory movement of the vertical center shaft is too violent to permit use of a drive belt arrangement, are problems which do not exist when a motor of ordinary type is coupled to flexible endless belt means and the drive means is located on the resiliently-mounted finishing chamber or on support means therefor, e.g., a central tubular housing for the vertical center shaft. From the foregoing, it is clear that the motor may be a universal motor which is rigidly attached either to the finishing chamber or to its support means, by which is included a portion of the housing within which the finishing chamber is contained or upon which the finishing chamber is supported.

OBJECTS OF THE INVENTION

It is accordingly an object of the present invention to provide a gyratory finishing apparatus having a motor mounted in such a position that it is readily accessible and removable for replacement or repair. It is a further object of the invention to provide such a gyratory finishing machine having the motor mounted on a floating portion of the apparatus. It is another object to provide such an apparatus which can utilize conventional motors which are readily available. It is still further an object to provide a gyratory finishing machine wherein the speed ratio between the motor and the rotating shaft may be readily changed, and wherein driving belts associated with the apparatus may be readily changed without disassembly of the apparatus. It is still a further object to provide a gyratory finishing apparatus having a finishing chamber which may be readily removed for replacement by smaller, larger, or different purpose units, or for repair. It is an additional object to provide an apparatus of the type described which may be readily and economically fabricated. Still other objects will readily present themselves to one skilled in the art upon reference to the ensuing specification, the drawings, and the claims.

BRIEF DESCRIPTION OF THE DRAWINGS

In the drawings, in which

FIG. 1 is a side elevational view, partly in cross-section, of a gyratory finishing machine according to one embodiment of the invention, now unclaimed herein.

FIG. 2 is a top view of the apparatus shown in FIG. 1.

DESCRIPTION OF THE PREFERRED EMBODIMENTS

Figure 1:
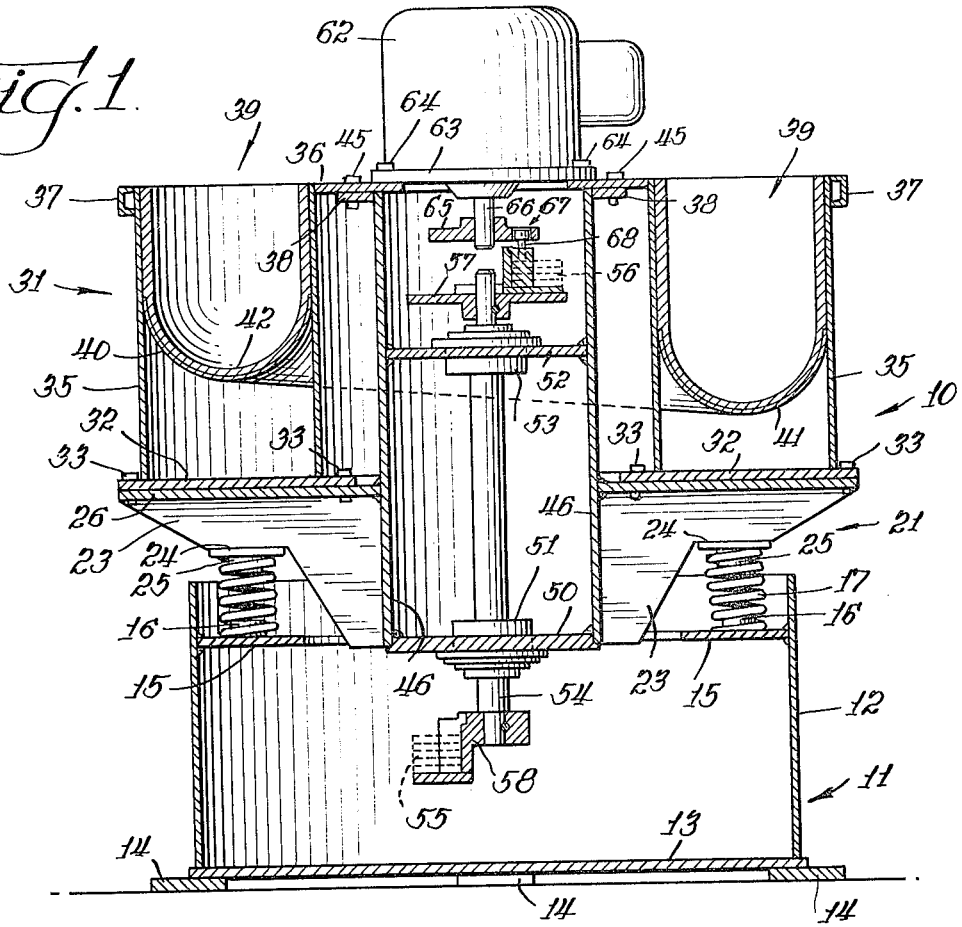
FIGS. 1 and 2 represent presently unclaimed embodiments provided only for a better understanding of the invention.
Figure 2:
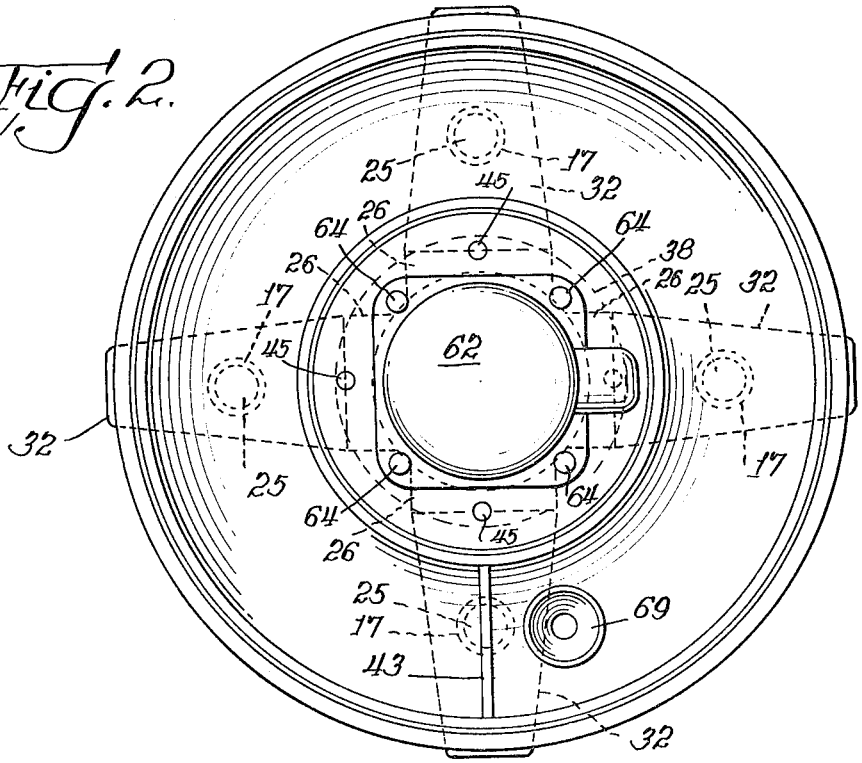

Referring to FIGS. 1 and 2, a gyratory finishing apparatus 10 is shown comprising a fixed base 11 having a cylindrical wall 12, a bottom 13, square foot plates 14, and a radially directed annular flange 15. Spring engaging protuberances 16 are affixed to the flange 15 for engaging one end of coil springs 17. Alternatively, a resilient material such as rubber or other plastic materials may be utilized in place of coil springs.

A floating supporting assembly 21 comprises a central tubular gyratory motion-producing assembly 22 and sheet-form radial supports 23. The radial supports 23 have square plates 24 affixed thereto on one edge which are provided with spring engaging protuberances 25 on the other surfaces of the plates which engage the upper ends of the coil springs 17. Horizontal radial supporting arms 26 are affixed to the radial supports 23 by means such as welding. The radial supports 23 and the radial supporting arms 26 are welded to each other and to the central tube assembly 22.

Mounted on the floating support assembly 21 is an annular finishing chamber or tub assembly 31. The finishing chamber assembly 31 has four horizontally disposed radial arms 32 of substantially the same size and shape as and which are detachably affixed to the radial supporting arms 26 by means of bolt and nut assemblies 33. Affixed to the radial arms 32 by means such as welding are an inner vertically arranged tubular finishing chamber support 34 and an outer vertically arranged tubular finishing chamber support 35. An annular radially oriented support flange 36 is affixed to the inner tubular support 34 by welding, and an annular channel-form rim 37 is affixed to the outer support 35 by means such as welding in order to reinforce the structure. An annular finishing chamber or tub 39 is disposed intermediate the supports 34 and 35 and affixed thereto by welding.

The central gyratory motion-producing assembly 22 comprises a vertically oriented tubular housing 46 affixed by welding at a lower portion thereof to the radial supports 23 and the radial supporting arms 26. An annular radial flange 38 is also provided at the upper edge of the tubular housing 46 for supporting the flange 36 provided on the support 34 by means of nuts and bolts 45. The annular finishing chamber 39 may be any of a large number of different sizes and shapes. The chamber shown in FIGS. 1 and 2 has an arcuate bottom 42 and is in the form of a single turn helix, having a shallower bottom 40 in one portion and a deeper bottom 41 in another. A vertical wall 43 (FIG. 3) separates the lowest portion of the bottom from the highest. Alternatively, finishing chambers having a horizontally arranged bottom or a helical bottom of more than one turn may be utilized. With such structures various separating devices known in the art may be utilized for removing the parts and returning the finishing material to the starting portion of the chamber.

Mounted in the lower portion of the tubular housing 46 is a lower bearing support plate 50 having a bearing 51 mounted thereon and an upper bearing plate 52 having a bearing 53 mounted thereon. An eccentric weight-supporting shaft 54 is rotatably journaled in the bearings 51 and 53 and has an arm 58 affixed to the end thereof supporting an eccentric or unbalance weight 55, in fixed radial relationship thereto. An upper eccentric or unbalance weight 56 is mounted at the other end of the shaft 54, in fixed radial relationship thereto, on an index plate 57 affixed to the shaft. A pancake-type motor 62 having a mounting flange 63 is affixed to the annular plate 36 by means of bolts 64. The motor 62 is coupled to the shaft 54 by means of a dog-type coupling comprising a disc 65 mounted on the motor shaft 66 having an aperture 67 provided therein. A pin 68 affixed to the eccentric weight 56 is disposed in the aperture 67 and couples the disc 65 with the eccentric weight 56. The motor 62 is so mounted that the motor shaft 66 is substantially coaxial with the shaft 54, the coupling arrangement compensating for minor abberations from true alignment. A bell reducer 69 with a perforated drain (FIGS. 2 and 3) is provided at a lower portion of the finishing chamber to permit materials such as fluids or finishing grit to be removed.

As can be seen in FIGS. 1 and 2, the motor 62 is mounted externally with respect to the shaft 54, bearings 51 and 53, and eccentric weights 55 and 56 of the gyratory motion-producing assembly 22. Consequently, the motor can be readily removed for repair or replacement without the necessity of disassembling the gyratory motion-producing assembly. Similarly, a replacement motor may be quickly remounted without disassembling the same structure. Although the motor is shown mounted completely external to the tubular housing 46, it may be mounted partially or even completely within the housing as long as it is positioned external to the shaft, the eccentric weights, and the bearings. Although only one form of coupling has been shown, other couplings known in the art such as conventional bi-flanged motor couplings or flexible shafts may be utilized. The motor can also be offset and the coupling can also comprise gears, belt and pulleys, chain and sprocket, a universal coupling, or any other suitable coupling means.

Figure 3:
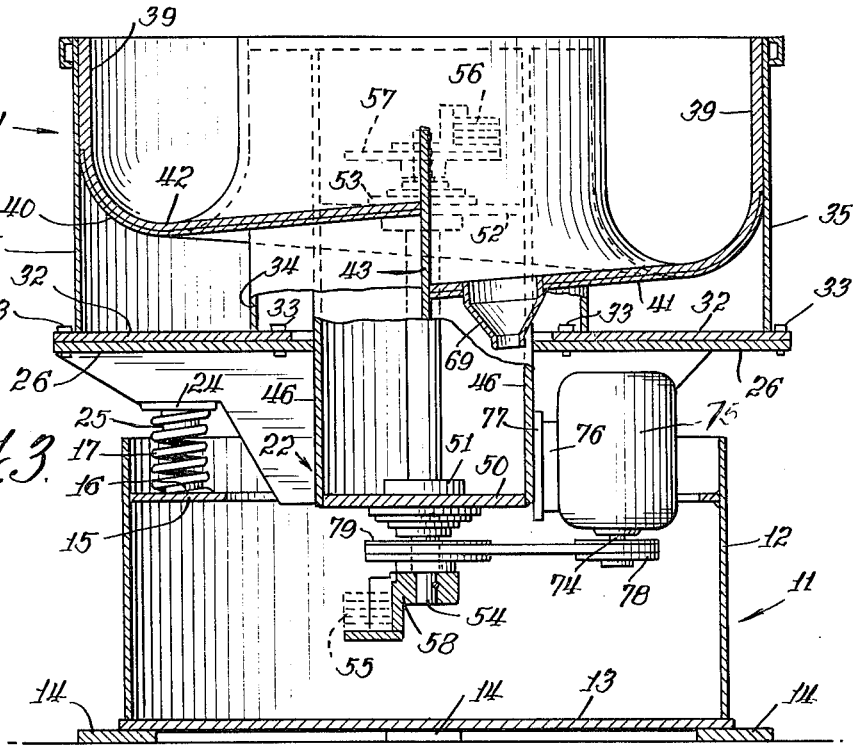
FIG. 3 is a side elevational view partly in cross-section of a finishing machine comprising another embodiment of the invention.

Referring to FIG. 3, a gyratory finishing machine is shown having a structure which is similar in most respects to that shown in FIGS. 1 and 2 and wherein similar structures bear the same numerals as in FIGS. 1 and 2. However, a motor 75 is mounted by means of a sliding base 76 and mounting plate 77 on the outer surface of the tubular housing 46 at the lower end thereof. The motor shaft 74 has a pulley 78 affixed thereto which is operatively connected to a pulley 79 mounted on the shaft 54 by means of an endless flexible belt 80.

In the embodiment shown in FIG. 3 the motor is ,ounted on the outer wall of the tubular housing, and consequently externally with respect to the bearings, shaft, and eccentric weights of the gyratory motion-producing assembly. This permits the motor of this assembly, as in that of FIGS. 1 and 2, to be readily removed and replaced without disassembling the gyratory motion-producing assembly. Such removal and replacement merely requires the removal and replacement of four bolts and removal and replacement of the endless flexible belt. The structure also permits flexible belts to be changed without disassembling the shaft and bearings, and also permits speed ratios to be changed by changing the pulleys or the motor without major disassembly.

Although, as shown, the motor is mounted on the outer surface of tubular housing 46 at the lower end thereof, the same being support means for the finishing chamber 31. The motor 75 could also be suitably mounted on any other portion of the housing or support means for the finishing chamber 31 or even the finishing chamber 31 itself, merely by selecting suitable sliding base 76 and mounting plate 77 arrangements and sizes.

Figure 4:
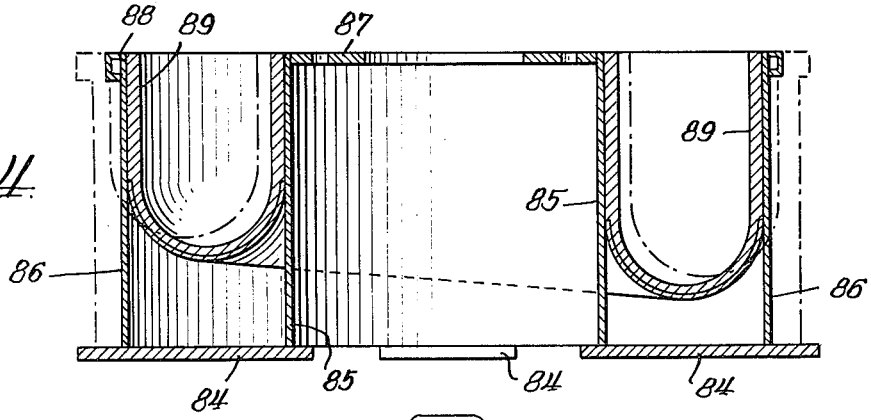
FIG. 4 is a cross-sectional view of a finishing chamber assembly such as utilized in the apparatus shown in FIGS. 1, 2, and 3.
Figure 5:
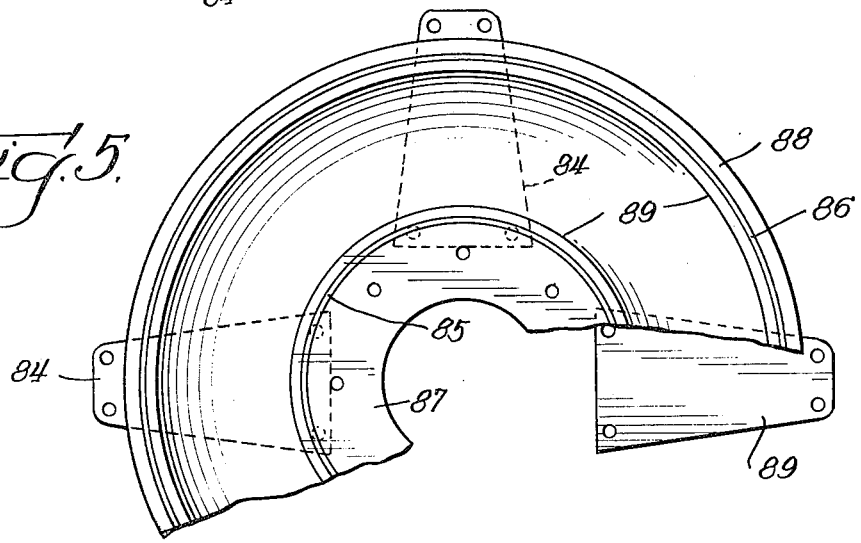
FIG. 5 is a fragmentary top view of the finishing chamber assembly shown in FIG. 4.

FIGS. 4 and 5 illustrate a finishing chamber assembly which has been demounted from a finishing machine such as that shown in FIGS. 1 and 3. The broken lines indicate the outline of a chamber of a size similar to that of FIGS. 1 and 3. The solid lines show a chamber which is somewhat smaller, but yet which may be mounted on the same basic machine. The structure comprises radial arms 84, an inner tubular support wall 85, and an outer tubular support wall 86, both welded to the radial arms 84. A radial flange 87 is welded to the upper edge of the inner tubular support 85 and a channel-form rim 88 is affixed by welding to the upper edge of the outer tubular support wall 86. An annular finishing chamber or tub 89 is affixed by welding intermediate the inner and outer tubular support walls 85 and 86. The finishing chamber assembly is mounted on the finishing machines shown in FIGS. 1 and 3 in the same manner as that shown therein.

Figure 6:
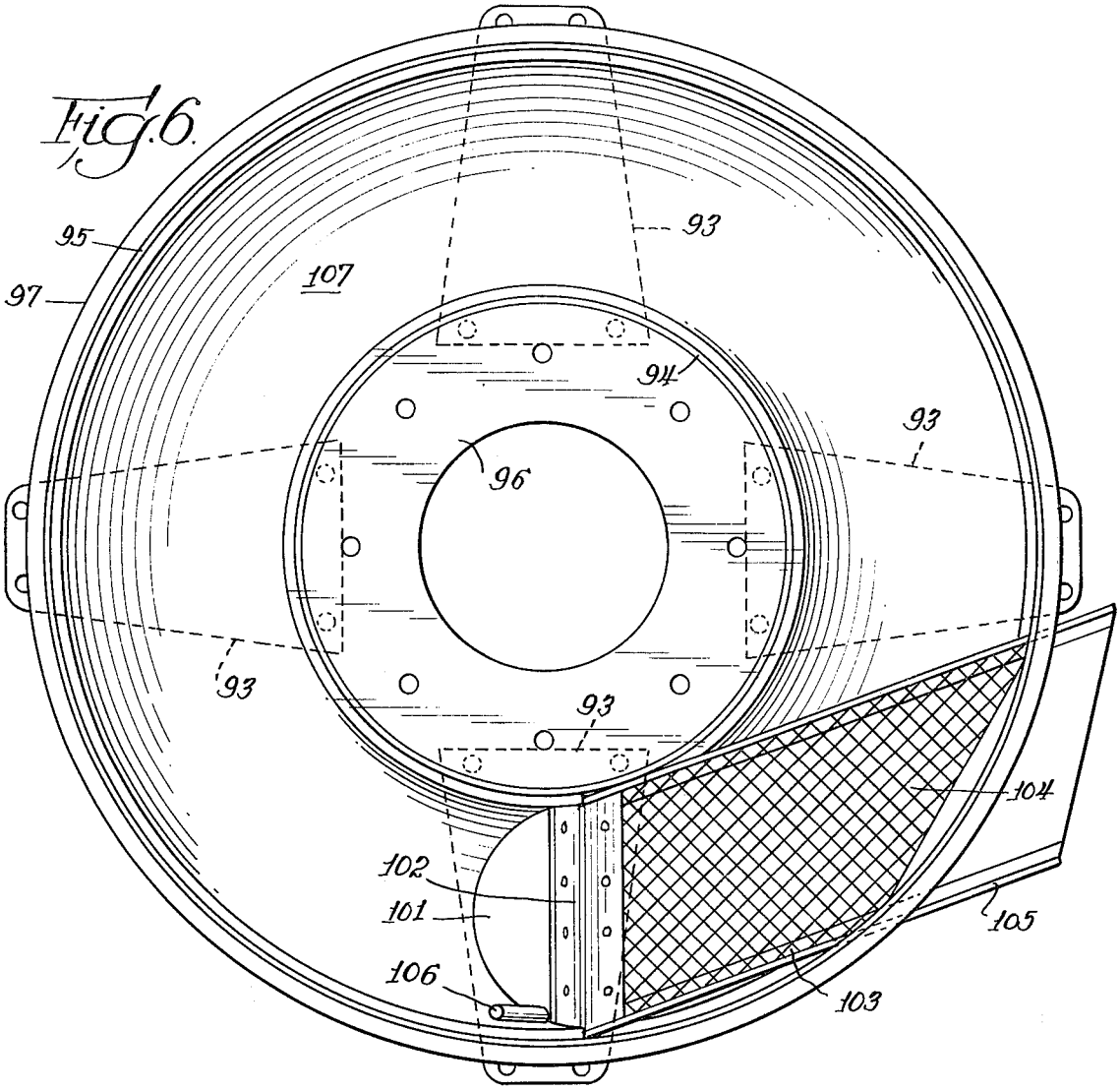
FIG. 6 is a top view of a finishing chamber assembly having a separating screen mounted thereon.
Figure 7:
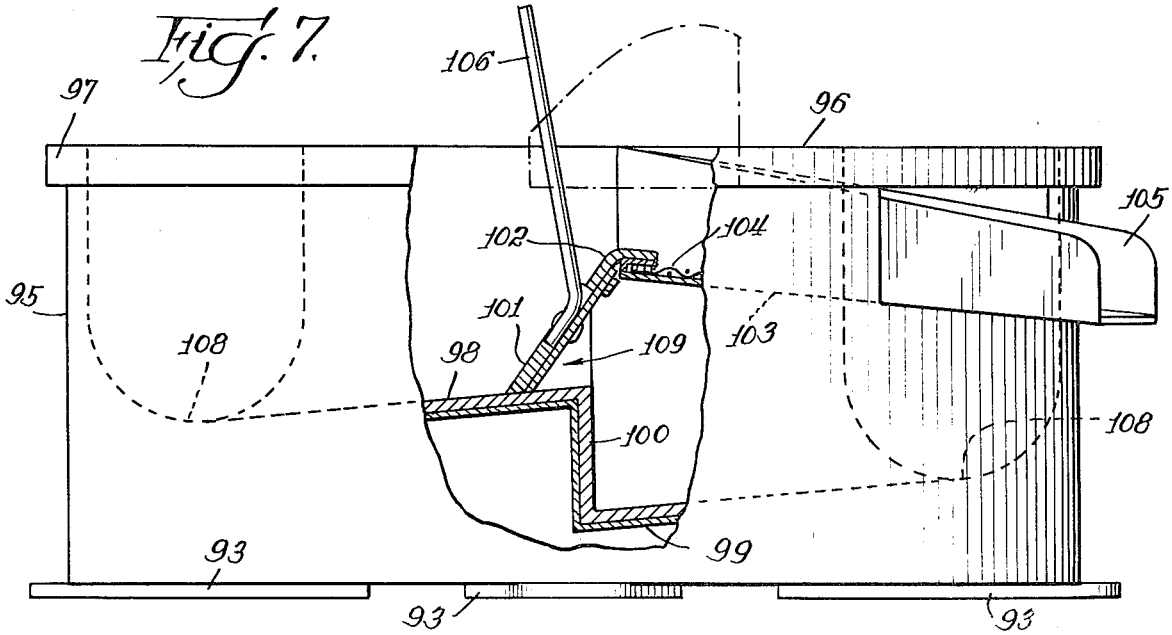
FIG. 7 is a side elevational view partly in cross-section of the finishing chamber assembly shown in FIG. 6.

Referring to FIGS. 6 and 7, a readily mountable and demountable finishing chamber assembly is shown which may be mounted on the finishing apparatus shown in FIGS. 1–3. The apparatus comprises radial arms 93, an inner tubular support wall 94, and an outer tubular support wall 95. A radial flange 95 is affixed to the inner support wall 94 and a channel-form rim 97 is affixed to the outer support wall 95. A finishing chamber or tub 107 is affixed by welding to the inner and outer support walls 94 and 95. The finishing chamber 107 is in the form of an annular trough having an arcuate bottom 108. Although the top of the trough is level around its entirety, the bottom is in the form of a single turn helix in a curvilinear direction, having an upper portion 98 and a lower portion 99 joined by a vertical wall 100. A port 109 is provided connecting the upper portion of the chamber with the lower portion of the chamber. Disposed over the port is a ramp gate 101 connected by means of a resilient sheet-form hinge 102 to an elevated separating device comprising a discharge chute 103 having a screen 104 or other foraminous member such as a grate at the bottom thereof and a discharge spout 105 at its end. An actuating rod 106 is affixed at one end to the ramp gate 101.

In operation of the embodiment shown in FIGS. 6 and 7, the parts to be finished and finishing material are placed in the lower portion 99 of the finishing chamber.

Rotation of the eccentric weight system causes a gyrational movement of the finishing chamber which produces orbital movement of the parts and material, and additionally causes both to move linearly in the ascending direction of the trough bottom of the finishing chamber. Prior to operation, the actuating rod 106 is moved forward (to the right in the view shown in FIG. 7), causing the ramp gate 101 to lift and the port 109 to be open. The motor is then turned on to initiate the finishing process. When the parts and finishing materials have progressed to the elevated portion 98 of the chamber, since the port 109 is open, the parts and materials pass down the wall 100 to the lower portion of the chamber 99, where another cycle begins, the procedure continuing for cycle after cycle. When the parts have been sufficiently finished, the actuating rod 106 is moved rearwardly (to the left of FIG. 7), causing the ramp gate 101 to lower into place and to close the port 109. Now when the parts and finishing material encounter the ramp gate 101 they are caused to ascend and to be deposited on the screen 104. The finishing material falls through the screen 104 and is returned to the finishing chamber. The parts continue along the screen and are discharged from the spout 105 into a suitable receptacle. Other separating devices known in the art may alternatively be used.

The finishing machine of the present invention has several important features which result in a number of advantages over prior art machines. First, the vertically oriented shaft carrying the eccentric weights is mounted in the gyratory housing by means of independent bearings, and consequently does not depend on the motor bearings to withstand the tremendous vibrational forces transmitted from the shaft to the housing. Because individual heavy duty bearings may be utilized for this purpose, expensive specially designed motors having heavy duty bearings are not required, but conventional universal motors having normal size bearings may be utilized. A second feature of the present invention is that the motor is mounted in fixed relationship with respect to the gyrating housing or floating part of the apparatus. Alternatively, the motor could be mounted on a supporting platform on which the gyratory housing is mounted, since in this case the motor would still be in fixed relationship with respect to the housing as on the floating platform on which the housing is mounted. The motor may be mounted completely exterior to the housing or may be recessed therein. It is accessible for removal in any case. A third feature of the present invention is that power from the motor to the rotating vertical gyratory shaft is applied at a point on the shaft or plane through the shaft which is axially external of the bearings supporting the shaft, that is, axially external to that portion of the shaft intermediate the bearings. In the presently-claimed embodiment in which the motor is mounted on the housing or floating support to one side of the shaft, and wherein a pair of pulleys and a belt are utilized for transmitting rotating force, the pulley is mounted on the vertical gyratory shaft at a point axially exterior of the bearings supporting the shaft, either above all the bearings or below all the bearings, or, in other words, the pulley is mounted on a portion of the shaft which is axially external of that portion of the shaft intermediate the bearings. This structure permits the belt to be removed for replacement and the pulleys to be removed for replacement or to change the speed ratio of the motor without requiring disassembly of the gyrating shaft and eccentric weight assembly.

The finishing machine of the present invention has several further advantages over prior art finishing machines. Because the motor is remotely mounted with respect to the gyratory motion-producing assembly, that is, the rotating shaft, bearings, and eccentric weights, the motor is readily accessible. Where the invention is in the form having the motor mounted on the external wall of the tubular housing, or otherwise on the floating support, it is merely necessary to remove the belt and then remove the mounting bolts. Here again the use of pulleys and a belt also permits the speed ratio between the motor and gyratory shaft to be changed without disassembly of shaft and bearings. Moreover, since the gyratory force of the eccentric weights is transmitted to the supporting tube through the supporting bearings, no undue force is exerted on the driving motor bearings. Consequently universal relatively inexpensive motors commonly available on the market may be utilized. When such a motor becomes worn out or defective, it can be readily replaced in only a short time with another relatively inexpensive motor. Because the motor is mounted on the gyrational tubular housing or on the finishing chamber itself, or on other support means therefor, i.e., on the floating platform on which the finishing chamber or its housing is mounted, and gyrates with the shaft, only simple coupling means such as flexible couplings or simple belt and pulley drive may be utilized to transmit power from the motor to the rotating shaft. Consequently, no complicated couplings or universal joints need be utilized for rotating the eccentric weight shaft, and frequent belt replacement is not required, as is the case where prior art structures utilize motors fixed to a non-gyrating or non-floating portion of the apparatus.

The invention additionally provides an advantage in that the finishing chamber is readily demountable and replaceable with larger or smaller or different purpose finishing chambers or finishing chambers of different shapes or construction. Additionally, the use of a separating system having a ramp gate cooperating with a connecting port, as described above, permits simplified removal of the parts from the finishing chamber when the finishing process is complete.

It is to be understood that the invention is not to be limited to the exact details of operation or structure shown and described, as obvious modifications and equivalents will be apparent to one skilled in the art.

I claim:

1. A gyratory finishing machine for finishing the surface of parts by vibration of a part or parts and loose particulate surface finishing material therein, comprising a curvilinear finishing chamber resiliently supported by suitable support means on a fixed base frame, a substantially vertically-oriented vibrator shaft, carrying eccentric weight means mounted on said shaft for operational rotation of said shaft with said eccentric weight means in fixed radial relationship thereto, said shaft being journaled in bearings mounted in fixed relationship with respect to said finishing chamber, and a motor laterally displaced from said vibrator shaft, pulley means on the drive shaft of said motor and pulley means driving said vibrator shaft, said pulley means being coupled by flexible endless belt means, characterized in that said motor is also supported for gyratory motion with said finishing chamber and with said vibrator shaft, being rigidly attached to said finishing chamber or its support means, and in that said pulley means driving said vibrator shaft is arranged at a point axially external of said bearings so that said belt means couples said motor drive shaft to the pulley means driving said vibrator shaft at a point axially external of said bearings.

2. A finishing machine according to claim 1, characterized in that the pulley means driving said vibrator shaft is affixed directly on said vibrator shaft.

3. A finishing machine according to claim 1, characterized in that an eccentric weight carried by said vibrator shaft is also arranged axially external of said bearings.

4. A gyratory finishing machine according to claim 2, characterized in that said belt means coupling said drive shaft to said vibrator shaft directly couples said drive shaft to a said vibrator shaft having a pair of eccentric weights mounted thereon, which said vibrator shaft is mounted in a housing comprising a generally vertically-oriented central tube having two bearings mounted therein, in which bearings said vibrator shaft is rotatably journaled, and wherein said motor is mounted on a component part of said housing with its drive shaft vertically-oriented and parallel to said vibrator shaft.

5. A gyratory finishing machine according to claim 4, wherein said finishing chamber is detachably mounted for convenient change to another finishing chamber having different dimensions to correspond with a change in driving ratio in the pulley and belt means whereby said drive shaft is coupled to said vibrator shaft.

* * * * *

UNITED STATES PATENT AND TRADEMARK OFFICE

CERTIFICATE OF CORRECTION

PATENT NO. : 4,329,817

DATED : May 18, 1982

INVENTOR(S) : Gunther W. Balz

It is certified that error appears in the above—identified patent and that said Letters Patent is hereby corrected as shown below:

Col. 4, line 32; "plastic" should read -- elastic --
Col. 5, line 34; "abberations" should read -- aberrations --
Col. 6, line 2; ",ounted" should read -- mounted --

Signed and Sealed this

*Seventh* Day of *September 1982*

[SEAL]

*Attest:*

GERALD J. MOSSINGHOFF

*Attesting Officer*

*Commissioner of Patents and Trademarks*